US006388379B1

(12) United States Patent
Makhov

(10) Patent No.: US 6,388,379 B1
(45) Date of Patent: May 14, 2002

(54) MAGNETRON HAVING A SECONDARY ELECTRON EMITTER ISOLATED FROM AN END SHIELD

(75) Inventor: Vladimir Makhov, Williamsport, PA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/380,248

(22) PCT Filed: Jan. 5, 1999

(86) PCT No.: PCT/RU99/00002

§ 371 Date: Aug. 30, 1999

§ 102(e) Date: Aug. 30, 1999

(87) PCT Pub. No.: WO99/35663

PCT Pub. Date: Jul. 15, 1999

(30) Foreign Application Priority Data

Jan. 5, 1999 (RU) ..... 98100560
Jan. 5, 1999 (RU) ..... 98100569

(51) Int. Cl.[7] ..... H01J 25/50; H01J 23/05

(52) U.S. Cl. ..... 315/39.51; 315/39.63; 315/39.67; 313/103 R

(58) Field of Search ..... 315/39.3, 39.51, 315/39.63, 39.67; 313/103 R, 346 R

(56) References Cited

U.S. PATENT DOCUMENTS

| | | | | |
|---|---|---|---|---|
| 2,412,824 A | | 12/1946 | McArthur | 250/27.5 |
| 2,437,240 A | | 3/1948 | Brown | 250/27.5 |
| 2,826,719 A | | 3/1958 | Donal, Jr. | 315/39.63 |
| 2,928,987 A | | 3/1960 | Peters, Jr. | 315/39.55 |
| 3,121,822 A | | 2/1964 | Boyd | 315/39.69 |
| 3,297,901 A | | 1/1967 | MacDonald et al. | 313/346 |
| 3,646,388 A | | 2/1972 | Dudley et al. | 313/338 |
| 3,896,332 A | | 7/1975 | Heathcote | 315/39.51 |
| 3,899,714 A | | 8/1975 | Esterson et al. | 315/39.51 |
| 3,988,636 A | * | 10/1976 | Sato et al. | 315/39.51 |
| 5,280,218 A | | 1/1994 | Smith | 315/39.3 |
| 5,348,934 A | | 9/1994 | Shaw | 315/39.3 |
| 5,382,867 A | | 1/1995 | Maruo et al. | 313/309 |
| 5,463,271 A | | 10/1995 | Geis et al. | 313/346 R |
| 6,005,347 A | * | 12/1999 | Lee | 315/39.63 |

FOREIGN PATENT DOCUMENTS

| | | | |
|---|---|---|---|
| EP | 0593768 | | 6/1992 |
| EP | 0 535 953 A2 | * | 4/1993 |
| FR | 1.306.999 | | 9/1962 |
| GB | 2317741 | | 12/1996 |
| GB | 2 308 224 | * | 6/1997 |
| JP | 62-113335 | | 11/1985 |
| JP | 63-226852 | | 3/1987 |
| JP | 9-185948 | | 10/1996 |
| RU | 320 852 A | * | 11/1972 |
| RU | 98715 | | 9/1976 |
| RU | 2040821 | | 4/1991 |
| RU | 2007777 | | 4/1992 |
| RU | 2071136 | | 5/1992 |
| RU | 2051439 | | 1/1993 |
| RU | 2115193 | | 3/1994 |
| RU | 2051439 | * | 12/1995 |
| RU | 2115195 | | 4/1996 |
| WO | WO95/26039 | | 3/1995 |
| WO | 95 26039 | * | 9/1995 |

* cited by examiner

*Primary Examiner*—Benny T. Lee
(74) *Attorney, Agent, or Firm*—Lowe Hauptman Gilman & Berner, LLP

(57) ABSTRACT

The present invention relates to magnetrons and is aimed to improve effectiveness of using a working surface of field-electron emitters, to improve reliability of devices under conditions of increased mechanical action. These objects are solved in the design of a magnetron, comprising an anode and a cathode disposed co-axially inside the anode, the cathode comprising a secondary-electron emitter; a field-electron emitter and lateral flanges functioning as focusing shields, wherein at least one of the focusing shields is located from the secondary-electron emitter and comprises at least one field-electron emitter with a working end-face thereof facing the surface of the secondary-electron emitter.

11 Claims, 3 Drawing Sheets

MAGNETRON HAVING A SECONDARY ELECTRON EMITTER ISOLATED FROM AN END SHIELD

RELATED APPLICATION

The present application claims priority of Russian Application Serial No. 98/10/0569 filed Jan. 5, 1999, entitled "MAGNETRON", which in turn claims priority from Russian Application Serial No. 98/10/0560 filed Jan. 5, 1999, entitled "M-TYPE MICROWAVE DEVICE" the disclosures of which are incorporated by reference herein in their entirety.

FIELD OF THE INVENTION

The present invention relates generally to the field of electronics and, more particularly, to vacuum electron devices intended to generate microwave electromagnetic radiation using an electron-transit time, namely to magnetrons.

In particular, the present invention relates to structural elements of magnetrons, namely to cathodes requiring no preliminary incandescence to perform electron emission. Especially, this invention relates to magnetrons with a low readiness time.

BACKGROUND OF THE INVENTION

Magnetrons comprising a cylindrical anode with evacuated internal and resonant cavities and a cathode disposed co-axially inside the anode, the cathode having focusing shields located on its end-faces and facing with their inner surfaces, a magnetron internal cavity, are known and widely used to generate microwave radiation.

There are commonly used cathodes making use of a combination of secondary electron emission caused by return to a cathode of a part of electrons travelling in the inter-electrode space along epicycloids, as well as ion bombardment with respect to the cathode, and field emission, i.e., the phenomenon of electron ejection from a conductor surface under the action of a fairly strong electric field, which initiates and sustains the secondary electron emission. A cylindrical cathode body which is co-axial with an anode is fabricated from material having improved secondary-emission properties.

A required quantity of field emission is primarily afforded by the shape of corresponding elements, in particular by their fabrication in the form of a sharpened element, and their location relative to cathode sections with secondary-emission properties. Thus, location of a field-emitter on a focusing flange to diminish a destructive effect of electron bombardment exerted on said cathode sections is known from USSR Inventor's Certificate No. 320,852 granted Nov. 4, 1971 to L. G. Nekrasov et al., for "*Cathode For M-Type Microwave Device*", Int. Cl. H01J 1/32.

RU Patent No. 2,051,439 granted Dec. 27, 1995 to V. I. Makhorv et al., for "*Magnetron*", Int. Cl. H01J 1/30, describes a magnetron comprising a cylindrical anode and a cathode composed of a secondary-electron emitter, focusing flanges whose apertures are provided with field-electron emitters isolated from the flanges, the field-electron emitters inducing a primary current to activate the magnetron. The design of this magnetron and operating principle of such design constitute the closest prior art with respect to the present invention.

The opportunity for field-electron emitters in this design to be at potential other than potential of secondary-electron emitters, made it possible to attain improvements in the, magnetron starting and operating effectiveness. At the same time, a cantilever attachment of field-electron emitters requires a significantly higher mounting accuracy and restricts possibilities of using this design under vibration conditions.

SUMMARY OF THE INVENTION

The principal objects of the present invention are: to improve effectiveness of using a working surface of a field-electron emitter, to simplify the design; and to improve mechanical strength and reliability of the magnetron, while ensuring protection from microwave radiation.

According to the present invention, these objects are solved in a magnetron comprising a cylindrical anode with evacuated internal and resonant cavities and a cathode assembly disposed co-axially inside the anode, the cathode assembly comprising a cylindrical secondary-electron emitter which is co-axial with the anode; a field-electron emitter made in the form of a sharpened element; and a pair of focusing shields located on the end-faces of the cathode assembly and defining along the anode and the secondary electron emitter, an evacuated resonant cavity. In this arrangement, the focusing shields (or at least one of them) are electrically isolated from the secondary-electron emitter, and the field-electron emitter is located on the inner surface of such focusing shield.

In one preferred embodiment of the present invention, the field-electron emitters are provided on their working end-faces with projections.

For a number of practical applications, a lateral surface of the field-electron emitter may be developed at random (may be corrugated, may have folds or projections, etc.).

In a preferred embodiment of the present invention, the ends of a secondary-electron emitter cylinder (or at least one of those ends) underlying a field-electron emitter end-face are made in the form of truncated cone with its inclined surface facing a vacuum gap between the anode and the cathode.

In another preferred embodiment of the present invention, the ends of the secondary-electron emitter cylinder (or at least one of those ends) underlying a field-electron emitter end-face are provided with notches to accommodate projections of the field-electron emitter.

In still another preferred embodiment of the present invention, a secondary-electron emitter region underlying a field-electron emitter end-face is coated with a film made of foreign material. Such a material is selected from the group consisting of metals, alloys, semiconductors and dielectrics having a secondary electron-emission coefficient greater than that of the secondary-electron emitter material.

Essential distinctions of the proposed magnetron consist in the electrical isolation of the focusing shield from the secondary-electron emitter and provision of such shield with the field-electron emitter whose working end-face-faces the surface of the secondary-electron emitter.

This distinctive feature gives rise to the solution of objectives in accordance with the present invention. In doing so, the primary current increase is attained at the expense of more efficient usage of the working surface of field-electron emitters, since, in accordance with the present arrangement, emission occurs from the larger surface of the film emitter.

An additional advantage of the present invention consists in the increase of a field emission current at the expense of possibility to use two focusing shields having the field-electron emitters and electrically isolated from the secondary-electron emitter.

The third advantage of the present invention consists in the possibility to step down the operating voltage of the device triggering by decreasing a gap between field-electron and secondary-electron emitters, while affording improvements in the screening properties of the focusing shields from microwave radiation, expansion of types of devices used and structural capabilities of field-electron emitters and employment of a wider range of materials and alloys, providing high secondary-electron emission coefficients, stability of volt-ampere characteristics and an extended service life of the devices.

Additional objects and advantages of the present invention will be set forth in the detailed description which follows, and in part will be obvious from the description, or may be learned by practice of the invention.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

Figure 1:
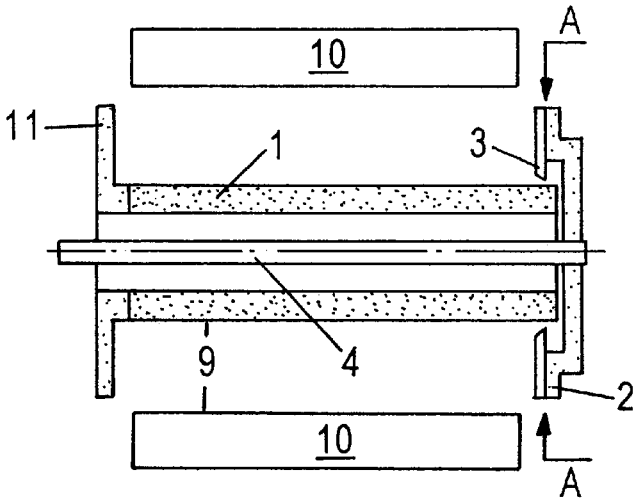
FIG. 1 is a schematic longitudinal (axial) section showing a magnetron in accordance with an embodiment of the present invention, wherein only one focusing shield is electrically isolated from a secondary-electron emitter.

In the drawings, the following definitions are provided for purposes of clarity and consistency;

1—secondary-electron emitter

2—isolated focusing shield

3—field-electron emitter

4—cylindrical rod

5—projections on the field-electron emitter

6—truncated cone

7—notches in the secondary-electron emitter

8—film

9—vacuum gap

10—anode of the magnetron

11—non-isolated focusing shield

DETAILED DESCRIPTION OF THE PREFERRED EMBODIMENTS

Figure 2:
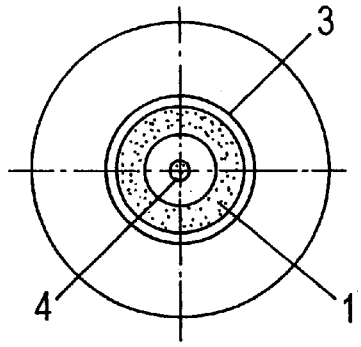
FIG. 2 is a schematic lateral (radial) section showing a magnetron cathode of FIG. 1, taken along the line A—A.

Referring first to FIGS. 1 and 2, there is shown a magnetron according to the present invention, comprising a solid anode 10, a cathode assembly disposed inside the anode, the cathode assembly comprising a cylindrical secondary-electron emitter 1 and a focusing shield 11 short-circuited with the emitter 1, as well as a focusing shield 2 attached to a cylindrical rod 4 and electrically isolated from the secondary-electron emitter 1, and a field-electron emitter 3 located on the shield 2, where the working end-face of the emitter 3 faces the surface of the secondary-electron emitter 1 and is separated therefrom with a vacuum gap 9 which isolates the anode and the cathode assembly of the device.

Figure 3:
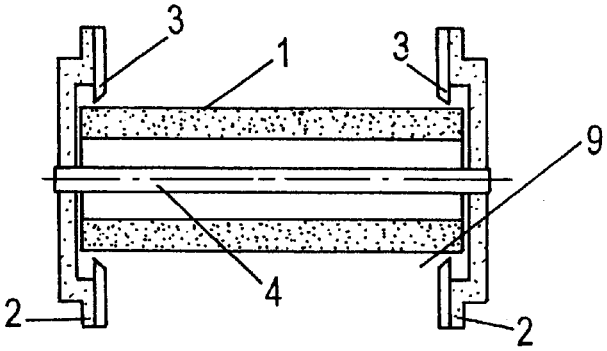
FIG. 3 is a schematic longitudinal (axial) section showing a magnetron cathode in accordance with an embodiment of the present invention, wherein both focusing shields are electronically isolated from a secondary-electron emitter.

Another embodiment of the present invention is illustrated with reference to FIG. 3. In this embodiment, both focusing shields 2 are located on the cylindrical rod 4 and electrically isolated from the secondary-electron emitter 1. In doing so, the field-electron emitters 3 are located on the both shields; they are separated from the secondary-electron emitter with a vacuum gap 9.

Figure 4:
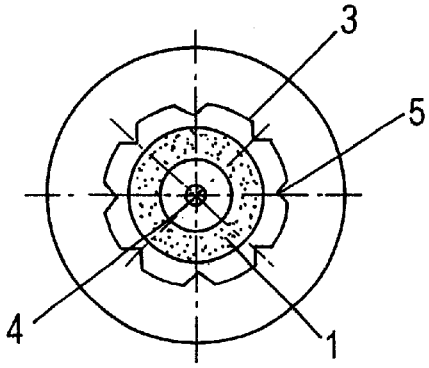
FIG. 4 is a schematic lateral (radial) section showing a magnetron cathode of FIG. 1, taken along the line A—A, wherein field-electron emitters are provided with projections on their working end-faces.

In an embodiment which is illustrated in FIG. 4 the field-electron emitter 3 is provided with projections 5 about the end-face periphery.

Figure 5:
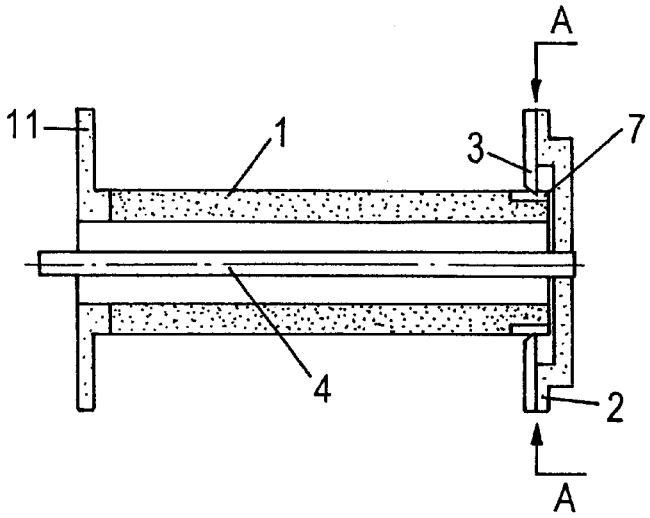
FIG. 5 is a schematic longitudinal (axial) section showing a magnetron cathode in accordance with an embodiment of the present invention, wherein only one focusing shield is electrically isolated from a secondary-electron emitter and an end of a secondary-electron emitter cylinder underlying the end-face of a field-electron emitter installed on this shield is provided with notches to accommodate projections of the field-electron emitter.
Figure 6:
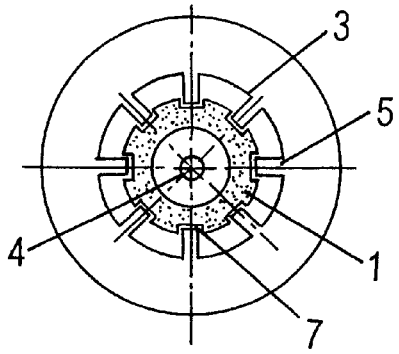
FIG. 6 is a schematic lateral (radial) section showing a cathode assembly of the magnetron of FIG. 5, taken along the line A—A.

In an embodiment which is illustrated in FIGS. 5 and 6 the secondary-electron emitter 1 is provided on its body with notches 7 in which, in order to diminish microwave radiation, projections 5 (see FIG. 6) of the field-electron emitter 3 are provided.

Figure 7:
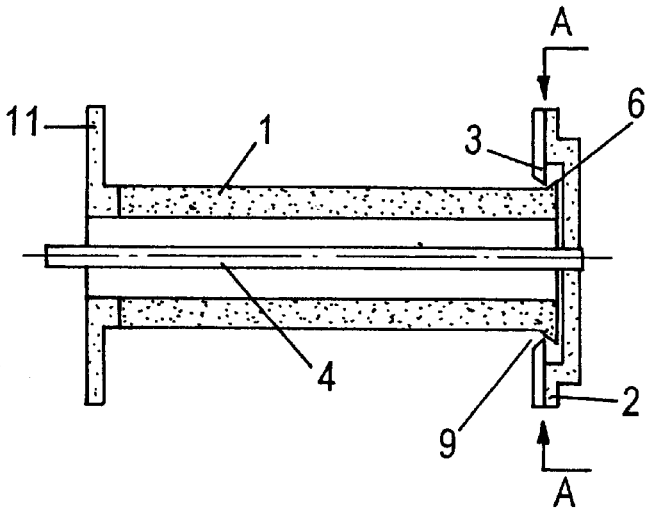
FIG. 7 is a schematic longitudinal (axial) section showing a magnetron cathode in accordance with an embodiment of the present invention, wherein only one focusing shield is electrically isolated from a secondary-electron emitter and an end of a secondary-electron emitter cylinder underlying the end-face of field-electron emitter installed on this shield is made in the form of truncated cone with its inclined surface facing a vacuum gap between the anode and the cathode.
Figure 8:
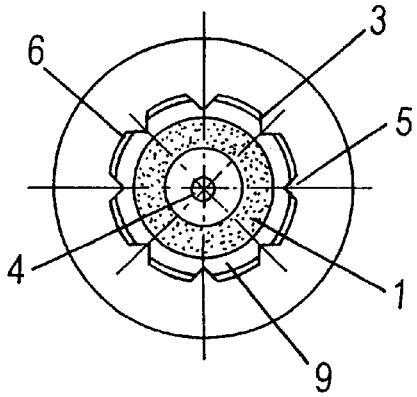
FIG. 8 is a schematic lateral (radial) section showing a cathode assembly of the magnetron of FIG. 7, taken along the line A—A.

In an embodiment which is illustrated in FIGS. 7 and 8 the secondary-electron emitter 1, in the region under the end-face of the field-electron emitter 3, is made in the form of truncated cone 6 whose inclined surface faces a vacuum gap 9 between the anode and the cathode assembly.

Figure 9:
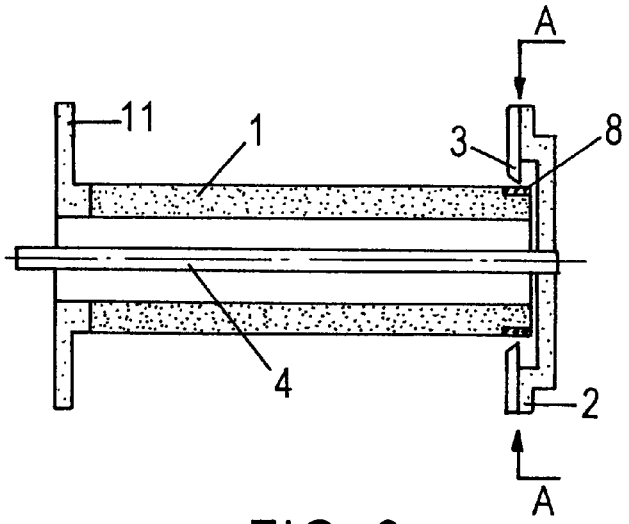
FIG. 9 is a schematic longitudinal (axial) notion showing a magnetron cathode in accordance with an embodiment of the present invention, wherein only one focusing shield is electrically isolated from a secondary-electron emitter and an end of a secondary-electron emitter cylinder underlying the end-face of a field-electron emitter installed on this shield is coated with a film made of foreign material.
Figure 10:
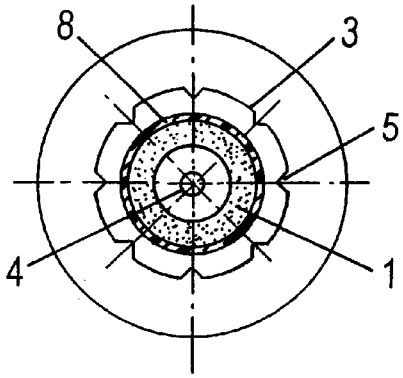
FIG. 10 is a schematic lateral (radial) section showing a cathode assembly of the magnetron of FIG. 9, taken along the line A—A.

Still another embodiment of the present invention is illustrated in FIGS. 9 and 10. In this disclosed embodiment, in order to increase an initial secondary current, there is used a film 8 applied to the region of the secondary-electron emitter 1 underlying the end-face of the field-electron emitter 3, the film 8 being fabricated from material other than that of the secondary-electron emitter 1 having a secondary electron-emission coefficient whose value is greater than that of the material of the secondary-electron emitter 1.

Additional advantages and modifications will readily occur to those skilled in the art. Therefore, the invention in its broader aspects is not limited to the specific details and illustrated embodiments shown and described therein.

A magnetron in accordance with the present invention operates as follows.

As best seen in FIG. 1, the anode 10 is connected to ground. Negative operating voltage is applied to the secondary-electron emitter 1. A magnetron excitation current is ensured by field emission from the secondary-electron emitter-facing working end-face of the field-electron emitter 3 located on one of the focusing shields 2, at the expense of the operating voltage applied by a specific circuit between said secondary-electron emitter 1 and field-electron emitter 3. Emitted field-electrons, accelerating under the action of electromagnetic field, fall on the surface of the secondary-electron emitter 1, knocking out secondary electrons which, in turn, being multiplied in avalanche-like fashion, provide for the operating current of the device.

Magnetrons in accordance with the present invention are more reliable, more efficient technologically and more effective economically.

INDUSTRIAL APPLICABILITY

The proposed invention may be widely used in vacuum electronics when designing highly-efficient instant-excitation magnetrons.

Although the present invention has been described with reference to a preferred embodiment, the invention is not limited to the details thereof and various changes and modifications obvious to one skilled in the art to which the invention pertains are deemed to be within the spirit, scope and contemplation of the invention as further defined in the appended claims.

What is claimed is:

1. A magnetron comprising a hollow cylindrical anode, and a cathode assembly co-axially surrounded by the anode, said cathode assembly comprising:

a cylindrical secondary-electron emitter co-axial with the anode;

at least one field-electron emitter provided with a respective sharpened working end-face; and a pair of focusing shields located on end-faces of the cathode assembly and defining, together with the anode and the secondary-electron emitter, an evacuated resonant cavity;

at least one of said focusing shields being electrically isolated from the secondary-electron emitter, and said at least one field-electron emitter being located on an inner surface of said at least one focusing shield within the evacuated resonant cavity with said respective sharpened working end-face adjacent to and spaced from an outer surface of the secondary-electron emitter.

2. The magnetron according to claim 1, wherein said at least one field-electron emitter comprises multiple field-electron emitters, and said pair of focusing shields are electrically isolated from the secondary-electron emitter with inner surfaces thereof being provided with the multiple field-electron emitters.

3. The magnetron according to claim 1, wherein said working end-face of the at least one field-electron emitter comprises projections extending inwardly toward the secondary-electron emitter.

4. The magnetron according to claim 3, wherein said secondary-electron emitter is provided with notches on the outer surface thereof to accommodate said projections of the at least one field-electron emitter.

5. The magnetron according to claim 1, wherein an end of the secondary-electron emitter, which is adjacent to said respective sharpened working end-face of said at least one field-electron emitter located on said at least one focusing shield, is a truncated cone flared toward said at least one focusing shield.

6. The magnetron according to claim 5, wherein the at least one field-electron emitter is ring-shaped having an innermost diameter smaller than the largest diameter of said truncated cone.

7. The magnetron according to claim 1, wherein a section of the outer surface of the secondary-electron emitter, which is adjacent to said respective sharpened working end-face of said at least one field-electron emitter, is coated with a film of a material having a secondary electron-emission coefficient greater than that of the secondary-electron emitter.

8. The magnetron according to claim 7, wherein the outer surface of the secondary-electron emitter is substantially devoid of said film except for said section.

9. The magnetron according to claim 1, wherein the at least one field-electron emitter is ring-shaped, and the secondary-electron emitter is arranged coaxially within the at least one ring-shaped field-electron emitter.

10. The magnetron according to claim 9, wherein said respective working end-face comprises a plurality of projections extending from an inner periphery of the at least one ring-shaped field-electron emitter radially inwardly toward the secondary-electron emitter.

11. The magnetron according to claim 10, wherein the secondary-electron emitter is further provided with a plurality of notches on said outer surface, each notch receiving a portion of a respective one of said projections without contacting said corresponding portion.

* * * * *